United States Patent [19]

Montacié

[11] 4,171,148

[45] Oct. 16, 1979

[54] CONTINUOUS BORING OR CUTTING MACHINE

[75] Inventor: Marcel Montacié, Paris, France

[73] Assignee: Bouygues, Clamart, France

[21] Appl. No.: 870,214

[22] Filed: Jan. 17, 1978

[30] Foreign Application Priority Data

Jan. 21, 1977 [FR] France ..... 77 01720

[51] Int. Cl.[2] ..... E21C 1/04

[52] U.S. Cl. ..... 299/61; 299/86

[58] Field of Search ..... 299/59, 61, 86, 87, 299/31, 56–58, 55; 74/90 R, 105

[56] References Cited

U.S. PATENT DOCUMENTS

| | | | |
|---|---|---|---|
| 3,035,822 | 5/1962 | Lundquist et al. | 299/61 |
| 3,109,635 | 11/1963 | Bergman | 299/86 |
| 3,118,310 | 1/1964 | Jablonsky | 74/105 |
| 3,713,700 | 1/1973 | Montacie | 299/86 |

FOREIGN PATENT DOCUMENTS

| | | | |
|---|---|---|---|
| 846051 | 8/1960 | United Kingdom | 74/105 |
| 264304 | 7/1970 | U.S.S.R. | 299/86 |

*Primary Examiner*—William Pate, III

*Attorney, Agent, or Firm*—Dressler, Goldsmith, Clement, Gordon & Shore, Ltd.

[57] ABSTRACT

The invention relates to a continuous boring or cutting machine provided with tools animated by a sweeping movement, said machine comprising a plurality of tool-holders mounted to oscillate on a rotating structure, these oscillations being controlled in synchronism by a rotary jack coaxial with respect to the rotating structure, the rod of the jack being fast with an element to which each tool-holder is connected by a connecting rod having a foot jointed on to said element and having a head jointed on to the tool-holder. The invention is more particularly applied to tunneling machines.

3 Claims, 3 Drawing Figures

PRIOR ART
FIG_1
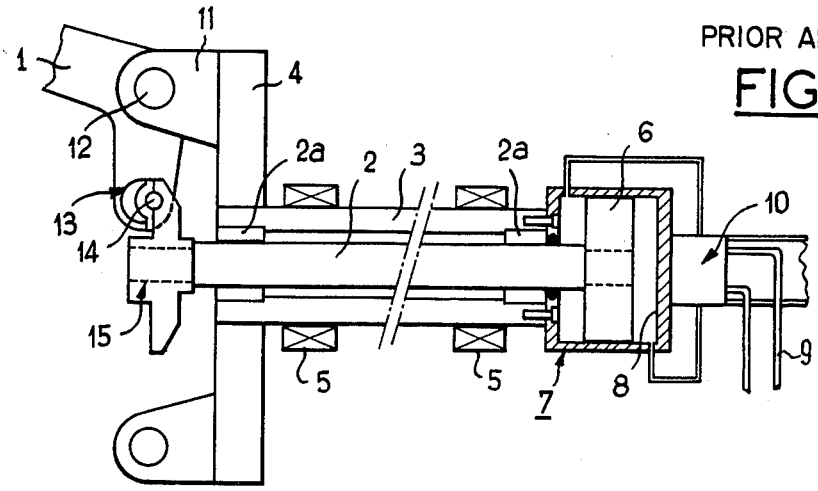
FIG_2
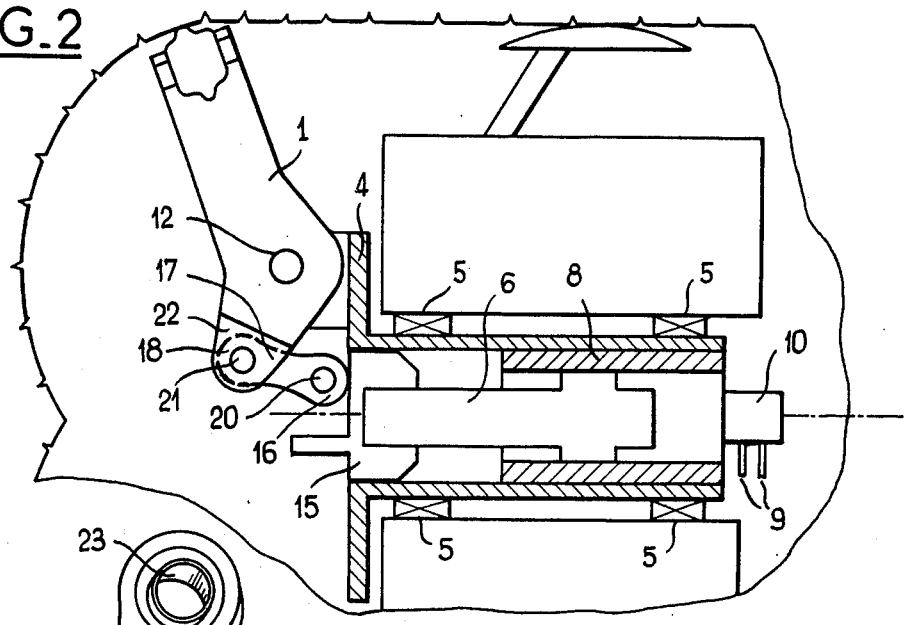
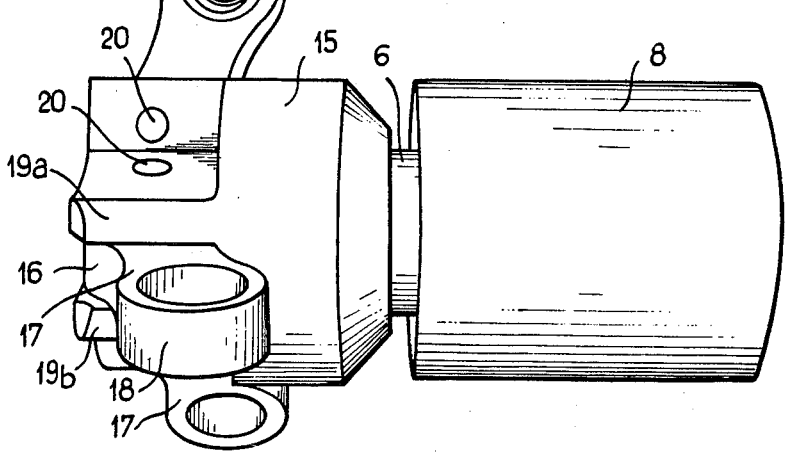
FIG_3

CONTINUOUS BORING OR CUTTING MACHINE

BACKGROUND OF THE INVENTION

The present invention relates to a continuous boring or cutting machine provided with tools animated by a sweeping movement.

These machines, which are particularly used for driving tunnels, are known for example by French Patent 1 597 434 and its Additions.

The third Addition 71 17770 to this Patent describes a machine comprising a plurality of tool holders mounted to oscillate on a common rotating structure, these oscillations being controlled in synchronism by a rotary jack coaxial with respect to the rotating structure, the rod of said jack being fast with an element to which each tool-holder is connected by an individual mechanical transmission essentially comprising an eccentric.

FIG. 1 of the accompanying drawings, which is taken from Addition 71 17770, schematically illustrates such a machine.

In This Figure, which is a view in longitudinal projection, the tool-holders 1, on which the tool or tools disposed at their ends have not been shown, are driven by a central piston rod 2 reciprocable along an axis on bearings 2*a* inside the hollow shaft 3 of the movable head 4 rotating between bearings 5. This rod 2 is fast with the piston 6 of a double acting jack 7, the cylinder 8 of which is supplied with pressurised oil via fixed tubes 9 through the rotating seal 10.

The tool-holder 1 is mounted on the shaft 12 which extends perpendicular to the axis for piston rod 2 and is fixed on an element 11 carried by the rotating head 4, and the connection of the tool-holder with the rod 2 is effected by a ball-and-socket joint 13 with eccentric axis 14 carried by an element 15 fixed to the end of the rod 2 opposite jack 7.

In practice, it is noted that a transmission thus produced by an eccentric may, in certain cases, and particularly when the machine is designed to drive tunnels of small diameter, of the order of 3 meters, give rise to risks of blocking due to the eccentrics.

SUMMARY OF THE INVENTION

It is an object of the present invention to provide a boring machine not having this drawback and which consequently is particularly suitable for driving tunnels of small diameter.

According to the present invention, the individual mechanical transmission and connection means between each tool-holder and the element fast with the rod of the jack is constituted by a connecting rod having a foot jointed on to said element and a head jointed on to said tool-holder.

BRIEF DESCRIPTION OF THE SEVERAL VIEWS OF THE DRAWINGS

The invention will be more readily understood on reading the following description with reference to the accompanying drawings, in which;

FIG. 1 shows the prior art type machine;

FIG. 2 shows a schematic longitudinal section through that part of the machine concerned by the invention, and FIG. 3 is a view in perspective of the essential elements of that part of the machine concerned by the invention.

DETAILED DESCRIPTION

Referring again to the drawings, FIGS. 2 and 3 essentially show the double-acting jack or fluid ram of which the cylinder 8 rotates with the rotating structure 4 and of which the piston rod 6 bears an element 15 on which are pivoted the feet 16 of three connecting rods and rigid links 17 whose heads 18 are respectively pivoted on the three tool-holder arms 1.

In this embodiment, the element 15 is so shaped as to present three fork-joints at circumferentially spaced locations and the feet of the connecting rods are received inside between the wings of these fork-joints respectively.

FIG. 3 shows the two wings 19*a* and 19*b* of one of these fork-joints which cooperate to defense a recess with a part of the connecting rod 17 mounted in the recess between wings 19*a* and 19*b*.

In the example shown, the foot of the connecting rod is jointed on to the fork-joint by means of a pin 20 which is carried by the wings 19*a*, 19*b* and which bears between said wings of the fork-joint a ball-and-socket joint which is housed in the foot of the connecting rod. Pin 20 is pivotally carried by wings 19*a*, 19*b*.

A corresponding assembly is made for the pivoting of the head of the connecting rod in the tool-holder. The tool-holder arm which pivots at 12 on the rotating structure comprises one end 22 in the form of a fork-joint, which receives, inside the fork-joint, the head 18 of the corresponding connecting rod, the pivoting being effected by a pin 21 carried by a fork-joint and provided with a ball-and-socket joint housed in the head of the connecting rod.

FIG. 3 simply shows the three connecting rods pivoted as described hereinabove on the star-shaped element 15 as well as the ball-and-socket joing 23 housed in the head of one of the connecting rods, before the tool-holder arm is connected to said head.

A man skilled in the art may make modifications to this embodiment without departing from the scope of the invention, particularly as far as the nature of the pivoting of the connecting rod on the star-shaped element on the one hand, and on the tool-holder on the other hand, is concerned.

What is claimed is:

1. In a continuous boring or cutting machine having a rotatable head rotated about a fixed axis, said rotatable head including a fluid ram having a cylinder secured to said head and a piston rod reciprocable along said axis, a plurality of tool-holders pivotally supported at circumferentially spaced locations on said rotatable head about axes generally perpendicular to said axis and connection means between said piston rod and each of said tool-holders for pivoting said tool-holders on said rotatable head in response to reciprocable movement of said piston rod, the improvement of each of said connection means including a rigid link rotatable with said piston rod and said rotatable head, each link having a first end pivoted on said piston rod and an opposite end pivoted on an associated tool-holder so that each tool-holder is pivoted between extreme positions in response to reciprocal movement of said piston rod between extreme positions.

2. A machine as defined in claim 1, in which each connection between each tool-holder link includes a ball-and-socket connection.

3. A machine as defined in claim 1, further including an element fixed to a free end of said piston rod with said element having a plurality of recesses equal in number to said links with one end of each link received into an associated recess with pins pivotally supporting said links in said recesses.

* * * * *